United States Patent [19]

Monrose

[11] Patent Number: 5,077,825

[45] Date of Patent: Dec. 31, 1991

[54] SPACE HEATER MOUNTED TO CEILING FAN

[76] Inventor: Ernest Monrose, 3872 - 50th Ave. South, St. Petersburg, Fla. 33711-4866

[21] Appl. No.: 667,842

[22] Filed: Mar. 12, 1991

[51] Int. Cl.[5] ..... H05B 3/00; F24H 3/02; F24H 9/00

[52] U.S. Cl. ..... 392/361; 392/364; 165/125; 362/226; 416/5; 416/95

[58] Field of Search ..... 392/360-369; 219/220, 213; 416/5, 95; 165/122, 125; 362/96, 226; 98/31.6

[56] References Cited

U.S. PATENT DOCUMENTS

| | | | |
|---|---|---|---|
| 1,426,604 | 8/1922 | Roys | 392/365 |
| 1,679,271 | 7/1928 | Sanctuary et al. | 392/360 |
| 1,687,544 | 10/1928 | Clark et al. | 392/361 |
| 1,699,201 | 1/1929 | Guth | 392/367 |
| 2,044,832 | 6/1936 | Child | 165/125 |
| 2,189,008 | 2/1940 | Kurth | 362/294 |
| 2,267,425 | 12/1941 | Rowe et al. | 165/125 |
| 2,318,393 | 5/1943 | Honerkamp et al. | 98/31.6 |
| 2,469,149 | 5/1949 | Blackwelder | 392/367 |
| 2,491,399 | 12/1949 | Thompson | 392/365 |
| 2,504,798 | 4/1950 | Brineu | 165/125 |
| 3,223,828 | 12/1965 | Mast | 392/365 |
| 4,146,776 | 3/1979 | Johansen | 165/125 |
| 4,151,811 | 5/1979 | Truhan | 119/21 |
| 4,508,958 | 4/1985 | Kan et al. | 165/122 |

FOREIGN PATENT DOCUMENTS

| | | | |
|---|---|---|---|
| 1079808 | 4/1960 | Fed. Rep. of Germany | 165/125 |
| 517102 | 4/1921 | France | 219/220 |
| 865167 | 4/1961 | United Kingdom | 165/125 |

*Primary Examiner*—C. L. Albritton
*Assistant Examiner*—John A. Jeffery
*Attorney, Agent, or Firm*—Joseph C. Mason, Jr.; Ronald E. Smith

[57] ABSTRACT

A space heater is mounted to a ceiling fan in close proximity to the housing of the fan motor. The housing is protected from heated air by an insulated, frusto-conical in configuration shield member. An elongate, flexible heating element is helically wound about the shield member. When the fan and heating element are operated at the same time, rotation of the fan blades causes the heated air to travel toward the ceiling at an angle determined by the frusto-conical configuration of the shield member. A cowling hides the heating elements from the view of occupants of an enclosed space within which the ceiling fan is mounted. The cowling is suitably apertured to allow air to circulate in contact with the heating element. Unheated air flows into the open lower end of the hollow shield member to cool the fan motor. A coupling member enables facile removal of the heater and further enables facile installation of a light kit when the heater is not is use.

3 Claims, 4 Drawing Sheets

SPACE HEATER MOUNTED TO CEILING FAN

TECHNICAL FIELD

This invention relates, generally, to space heaters. More particularly, it relates to a space heater that is mounted on a ceiling fan to enhance distribution of heated air throughout an enclosed space.

BACKGROUND ART

Space heaters are usually provided in the form of free-standing units. Typically, they include one or more heating elements, limited to fifteen hundred watts of power output by federal regulations, and a fan for circulating air therethrough.

Since heated air is less dense than cool air, it rises. Thus, a typical floor-supported space heater takes a long time to warm up a room, because the warmed air rises to the ceiling while the cool air remains in the lower, occupied area of the room. The occupants of the room don't feel the warm air until the cool air at the bottom of the room finally becomes warm. In high ceiling rooms, or poorly insulated rooms, the higher spaces of the room may never become filled with heated air, thereby insuring that the lower occupied regions will also remain unheated.

Even in a well insulated room with a low ceiling, a considerable amount of air must be heated before the occupants become comfortable.

One response to this problem has been to harness the air-circulating capabilities of the common ceiling fan to enhance the work of the space heater. By operating the fan so that air in the room is directed upwardly, i.e., toward the ceiling, an air flow pattern is established whereby cool air in the lower regions of the room is pulled upwardly, away from the occupants, and the heated air is routed down to the lower regions of the room. This mixing of the air molecules distributes the warmed air evenly throughout the room, thereby increasing the comfort of the room's occupants.

The general idea of mounting heating elements of the type found in conventional space heaters to ceiling fans is shown in U.S. Pat. No. 4,508,958, Kan, et. al. In the Kan construction, one or more electrical heating elements are positioned within the fan housing an around the outside of the rotor. Operation of the ceiling fan generates a flow of air through the housing, over the heating elements, and out into the stream of air created by the rotation of the blades. The heated air is directed downwardly.

A space heater of generally conical construction that may be mounted to a ceiling is shown in U.S. Pat. No. 2,221,703 to Falco; that space heater includes an impeller that may operate in opposite directions of rotation. Heated air is directed downwardly in a first direction of impeller rotation, and radially outwardly in a second direction of impeller rotation. Like the Kan, et. al., device, no means are provided to direct warm air toward the ceiling.

Still further U.S. Patents of interest include U.S. Pat. Nos. 2,130,802 to Kisling, 4,146,776 to Johansen, 4,151,811 to Truhan, and 2,189,008 to Kurth.

One of ordinary skill in this art, upon surveying the prior art, taken as a whole, would conclude that this art has been well developed, and that future advances in the art will consist primarily of obvious modifications to the existing devices.

DISCLOSURE OF INVENTION

This art is now advanced in a non-obvious way by a novel structure that overcomes the limitations of the devices heretofore known.

An insulated, hollow shield of frustro-conical configuration is added to a ceiling fan to direct circulating air toward a room ceiling at a predetermined angle.

One or more heating elements are positioned in helical array around the frusto-conical shield. The heating elements are at least partially hidden from view by a cowling that is suitably apertured to allow air flow over the heating elements.

The open lower end of the shield allows unheated air to cool the fan's motor.

A novel coupling means is also provided so that the heating elements, shield and cowling assembly may be removed when air heating is no longer required. The coupling means accepts a light kit which replaces the heating unit during the warmer months of the year.

It should therefore be understood that the primary object of this invention is to disclose a ceiling fan-mounted space heater having a frusto-conical in configuration shield member that protects the fan motor from overheating and which directs the circulating air in an optimal pattern.

These and other important objects, advantages, and features of the invention will become apparent as this description proceeds. The invention accordingly comprises the features of construction, combination of elements and arrangements of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
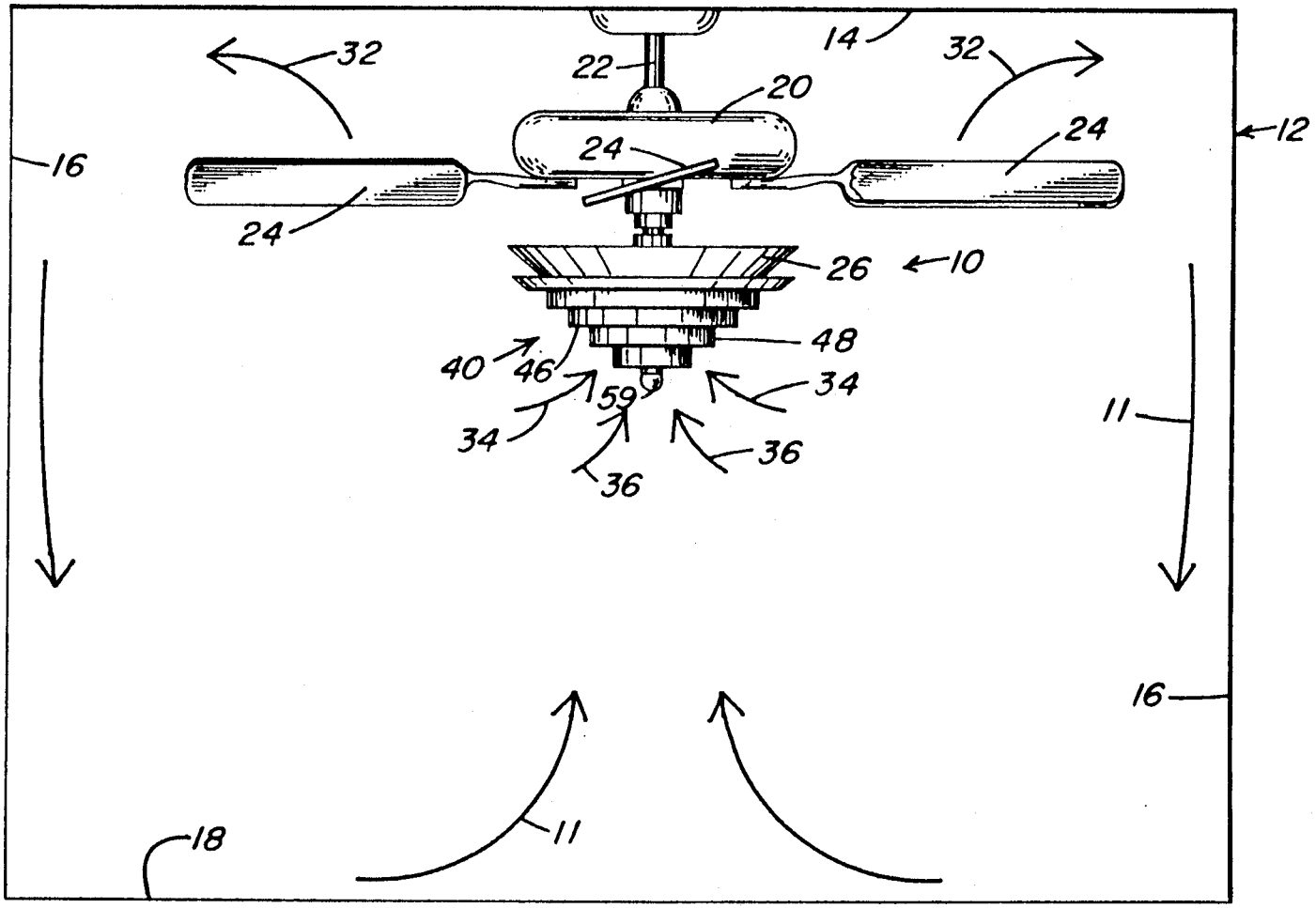
FIG. 1 is a side elevational view of the novel fan and space heater unit suspended from the ceiling of an enclosed space; the size of the fan is greatly enlarged with respect to the size of the room.

Referring now to FIG. 1, it will there be seen that an exemplary embodiment of the present invention is denoted as a whole by the reference numeral 10.

An enclosed space 12 includes a ceiling 14, vertical walls 16 and a floor 18. A fan motor housing 20 is suspended from ceiling 14 by support tube 22. Fan blades 24 may be mounted to the top wall of motor housing 20 or to the bottom wall thereof as depicted.

Figure 4:
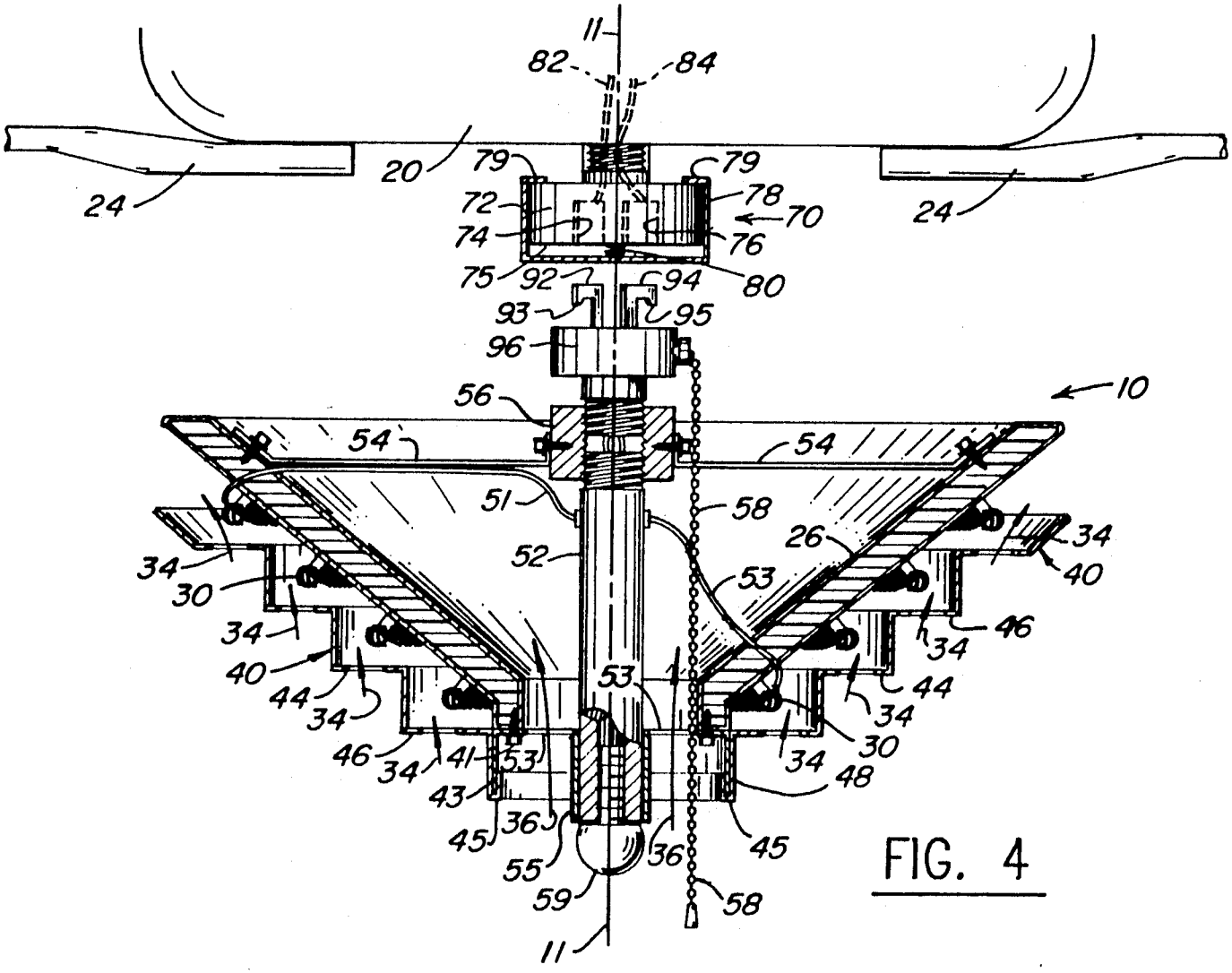
FIG. 4 is a side elevational, partially sectional view of the novel unit.

As best shown in FIG. 4, an insulated shield 26 of frusto-conical configuration has an axis of symmetry 11 that is coincident with the axis of rotation of the output shaft of the motor in housing 20. An elongate, flexible heating element 30 circumscribes shield 26, and follows a helical path of travel thereabout.

The air flow generated by the novel shield is denoted by plural directional arrows, collectively denoted 11 in FIG. 1. Note that the angle of shield 26 (FIG. 4) affects the direction of air flow at the beginning of the path of travel that commences at the fan. More particularly, the initial part of the path of travel is denoted 32 (FIG. 1); note that heated air flowing upwardly and radially outwardly as denoted by arrows 32 impacts ceiling 14 at an angle complementary to the angle of shield 26. This insures a good circulation of air throughout the enclosed space.

Directional arrows 34 and 36, shown in FIGS. 1 and 4, indicate the upward flow of cool air molecules as they approach the novel unit 10. The air molecules following the radially outermost path of travel, denoted 34, will pass over and be heated by heating element 30 as best shown in FIG. 4. The air molecules following the radially innermost path of travel, denoted 36, bypass the heating elements and flow through the hollow interior of shield 26 to cool the motor within housing 20.

Figure 3:
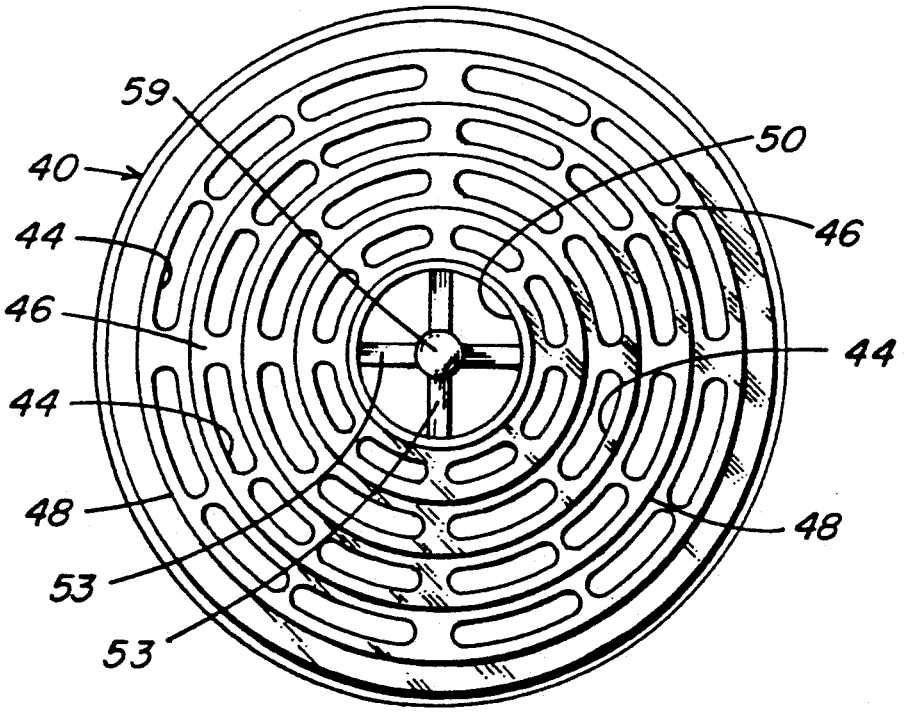
FIG. 3 is a bottom plan view of the cowling.

As perhaps best understood in connection with FIG. 4, cowling 40 substantially shields the heating element 30 from view. A plurality of circumferentially extending apertures, collectively denoted 44, (FIG. 3) are formed in cowling 40. These apertures allow cool air to flow over the heating element 30, as indicated by the above-mentioned directional arrows 34 in FIG. 1 and as better depicted in FIG. 4 as aforesaid.

Cowling 40 has a stepped structure as shown; apertures 44 are formed in the respective horizontal walls 46 thereof. The vertical walls 48 are imperforate to constrain the air molecules to follow the contour of shield 26, i.e., to constrain said molecules to flow upwardly and radially outwardly. Note that screws 41 secure a cylindrical member 43 to the annular bottom edge of shield 26, and that the lowermost annular edge of cowling 40 is crimped to said member 43, as indicated by the reference numeral 45.

Figure 2:
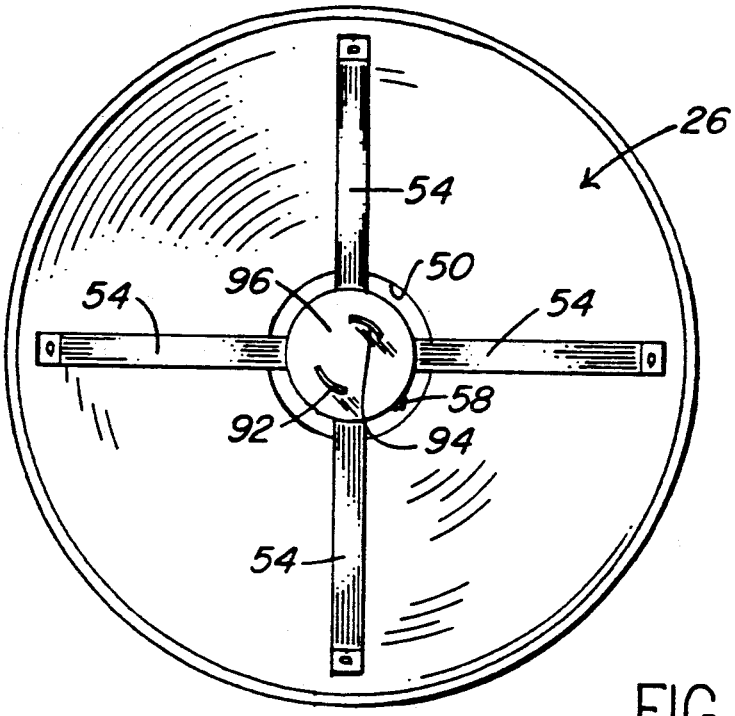
FIG. 2 is a top plan view of the frusto-conical shield and the brace members associated therewith.

Central opening 50, at the lower end of shield 26, admits unheated air 36 to cool the fan motor as aforesaid, and also accommodates central support rod 52 to which shield 26 is attached, in the manner best depicted in FIG. 4. Plural brace members 54 interconnect shield 26 and internally threaded sleeve member 56 as shown in FIGS. 2 and 4. Rod 52 is hollow as shown in FIG. 4 and provides a housing for conductors 51, 53, the respective leading ends of which are in electrical communication with opposite ends of heating element 30 as shown and the respective trailing ends of which are in electrical communication with plugs 92, 94.

Chain 58 when pulled a first time activates the fan motor; when pulled a second, third, and fourth time, it connects heating element 30 to a second, third, and fourth current that produces 500, 750, and 1500 watts of power, respectively. A separate chain could be provided for the fan motor only, and indicator means could be provided to indicate the settings of the heater. Cap 55 overlies the lowermost end of rod 52 and is secured thereto by an externally threaded screw having decorative head 59. Plural brace members, collectively denoted 53, shown in FIGS. 3 and 4, stabilize the lower end of support rod 52.

Figure 5:
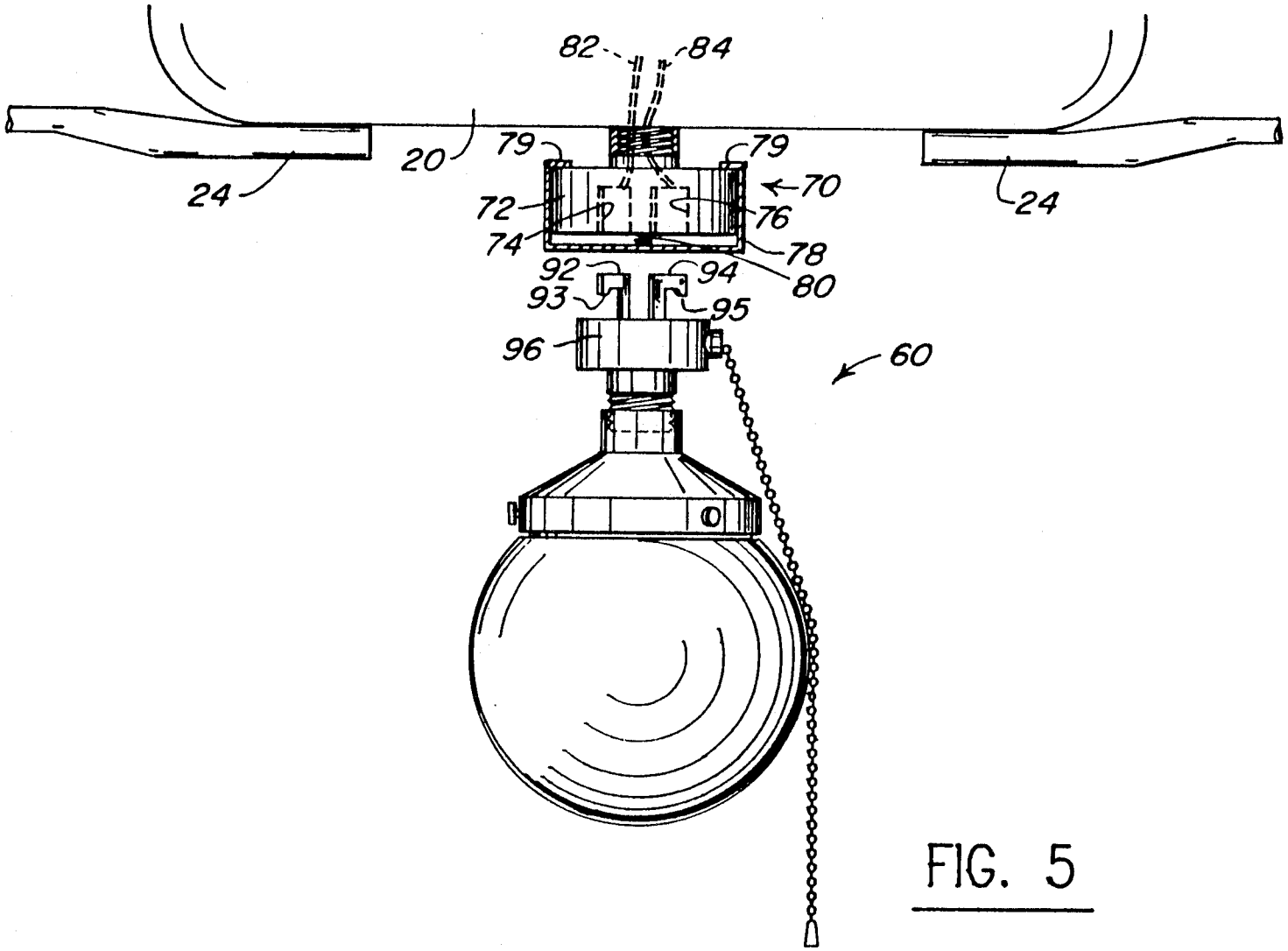
FIG. 5 is a side elevational view showing how a light kit is mounted to the ceiling fan when the heater is not in use.

FIGS. 4 and 5 show the novel means for coupling either heater unit 10 or light kit 60 to a ceiling fan. The novel heater 10 is attached to the ceiling fan in the same way as light kit 60 is attached. Thus, it is convenient to attach the novel heater to the fan during the cold months of the year, and to remove said heater and install the light kit during the warm months of the year.

More particularly, a coupler mechanism 70 (FIGS. 4 and 5) includes a socket member 72 having a pair of recesses 74, 76 formed therein. Socket 72 is slidably received within socket housing 78 which includes radially inwardly extending catches 79 to prevent disengagement of said housing from said socket. A bias means in the form of spring 80 biases housing 78 downwardly away from socket 72. Note that electrical wires 82, 84 terminate at the base of recesses 74, 76, respectively.

As shown in FIGS. 4 and 5, both the heater unit 10 (FIG. 4) and light kit 60 (FIG. 5) include a pair of plug members 92, 94 that are fixedly secured to base member 96 and which project upwardly therefrom as depicted. To couple either the heater unit or the light kit, the plugs 92, 94 are inserted into their respective recesses 74, 76 and base 96 is brought to bear against housing 78 so that it compresses spring 80. The unit 10 or light kit 60 is then rotated about its axis until the downwardly bent tips 93, 95 of plugs 92, 94 align with complementally formed slots in bottom wall 75 of socket member 72. Such alignment allows spring 80 to unload and effectively locks the heater or light kit into position, and allows said tips to make electrical contact with electrical terminals, thereby completing the electrical circuit. Uncoupling is accomplished by compressing spring 80 until the tips 93, 95 of the plugs 92, 94 are lifted from their slots, rotating the device and separating the unit. Note that plugs 92, 94 are in electrical communication with wires 82, 84 when the heater or light kit is installed.

This invention is clearly new and useful. Moreover, it was not obvious to those of ordinary skill in the art at the time it was made, in view of the prior art when considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

I is also to be understood that the following claims are intended to cover all of the generic and specific features of the invention herein described, and all statements of the scope of the invention which, as a matter of language, might be said to fall therebetween.

Now that the invention has been described, what is claimed is:

1. A space heater that is mountable to a ceiling fan, comprising:

an insulated frustoconical shield member having an outer surface, an inner surface, and a hollow interior;

said shield member having a large diameter, open upper end and a small diameter, open lower end which defines an air flow passage to the hollow interior of said shield member;

a helical heating element disposed in wound relation about said shield member in overlying relation to said outer surface;

a cowling disposed in close proximity to said shield member, radially outwardly thereof, to substantially conceal from view said heating element;

said cowling having a stepped structure including a plurality of concentric imperforate vertical walls and a plurality of concentric horizontal walls;

a plurality of circumferentially extending apertures formed in each of said horizontal walls for allowing the aspiration of air into the space between said shield member and said cowling and in contact with said heating element;

a central support rod;

brace means for connecting said shield member to said support rod;

fastening means for connecting said cowling to said shield member;

a support tube for supporting a ceiling fan;

a socket housing secured to a lowermost end of said support tube; and a coupler means for releasably connecting said central support rod to said socket housing;

whereby said shield member and said cowling are relesably connected to said support tube;

whereby rotation of said ceiling fan causes an airflow where some air enters into the hollow interior of said shield member through its open lower end and exits said hollow interior through its open upper end, thereby bypassing said heating element; and whereby some air in said airflow enters said circumferentially extending apertures and is warmed by contact with said heating element and is disbursed in an upward and radially outwardly direction with respect to said support rod;

whereby said air that bypasses said heating element cools a fan motor supported by said support rod; and whereby said air that is heated is directed away from said fan motor by said shield member.

2. The space heater of claim 1, wherein said support rod and said support tube are hollow to receive electrical leads therethrough that supply power to said heating element.

3. The space heater of claim 2, wherein said large diameter open end of said shield member has a diameter substantially equal to a diameter of said fan motor so that said fan motor is shielded by said shield member from heated air that has contacted said heating element.

* * * * *